US008111216B2

(12) United States Patent
Chan et al.

(10) Patent No.: US 8,111,216 B2
(45) **Date of Patent: *Feb. 7, 2012**

(54) DISPLAY SYSTEM AND PIXEL DRIVING CIRCUIT THEREOF

(75) Inventors: Chuan-Yi Chan, Taipei (TW); Ping-Lin Liu, Tainan (TW); Du-Zen Peng, Hsinchu (TW)

(73) Assignee: Chimei Innolux Corporation, Miao-Li County (TW)

( * ) Notice: Subject to any disclaimer, the term of this patent is extended or adjusted under 35 U.S.C. 154(b) by 1090 days.

This patent is subject to a terminal disclaimer.

(21) Appl. No.: 11/954,257

(22) Filed: Dec. 12, 2007

(65) Prior Publication Data

US 2008/0088547 A1 Apr. 17, 2008

Related U.S. Application Data

(63) Continuation-in-part of application No. 11/801,162, filed on May 8, 2007, now Pat. No. 7,817,120.

(30) Foreign Application Priority Data

May 9, 2006 (TW) ..... 95116371 A

(51) Int. Cl.
*G09G 3/30* (2006.01)

(52) U.S. Cl. ..... 345/76; 345/82

(58) Field of Classification Search ..... 345/76, 345/87–102, 204

See application file for complete search history.

(56) References Cited

U.S. PATENT DOCUMENTS

| | | | | |
|---|---|---|---|---|
| 6,486,606 | B1 * | 11/2002 | Ting | 315/169.1 |
| 6,977,634 | B2 * | 12/2005 | Kim et al. | 345/87 |
| 2003/0122756 | A1 * | 7/2003 | Kim et al. | 345/87 |
| 2005/0237281 | A1 * | 10/2005 | Tam | 345/76 |
| 2006/0221013 | A1 * | 10/2006 | Kimura | 345/76 |
| 2007/0262931 | A1 * | 11/2007 | Peng et al. | 345/76 |

OTHER PUBLICATIONS

"44.1: A 1.8-in QVGA Amoled Display with New Driving Method and Ultra Slim Technology" Won-Kyu Kwak et al., SID 05 Digest, 2005.

* cited by examiner

*Primary Examiner* — Nitin Patel
(74) *Attorney, Agent, or Firm* — Thomas|Kayden

(57) ABSTRACT

A pixel driving circuit comprises a storage capacitor, a transistor, a transfer circuit, a driving element, and a switch circuit. The storage capacitor comprises first and second nodes. The transistor has a gate coupled to a discharge signal and is coupled between the first and second nodes. The discharge signal turns on the transistor in first and second discharge periods to discharge the storage capacitor. The transfer circuit outputs a data signal or a reference signal to the first node of the storage capacitor. The switch circuit is coupled to the driving element, a first display element and a second display element. The switch circuit can make the driving element diode-connected in first and second data load periods, and allow a driving current through a first display element in a first light-emitting period and a second display element in a second light-emitting period.

20 Claims, 10 Drawing Sheets

500

600

DISPLAY SYSTEM AND PIXEL DRIVING CIRCUIT THEREOF

CROSS REFERENCE TO RELATED APPLICATIONS

This application is a Continuation-In-Part of pending U.S. patent application Ser. No. 11/801,162, filed May 8, 2007 and entitled "system for displaying image and driving display element method".

BACKGROUND OF THE INVENTION

1. Field of the Invention

The invention relates to a display system and, in particular, to a display system with a pixel driving circuit compensating threshold voltage and power loss.

2. Description of the Related Art

Organic light emitting diode (OLED) displays that use organic compounds as a lighting material for illumination are flat displays. The advantages of the OLED displays are a smaller size, lighter weight, wider viewing angle, higher contrast ratio and faster speed.

Active matrix organic light emitting diode (AMOLED) displays are currently emerging as the next generation flat panel displays. Compared with active matrix liquid crystal displays (AMLCD), the AMOLED display has many advantages, such as higher contrast ratio, wider viewing angle, and thinner module without backlight, lower power consumption, and lower cost. Unlike the AMLCD display, which is driven by a voltage source, an AMOLED display requires a current source to drive a display device EL (electroluminescent). The brightness of display device EL is proportional to the current conducted thereby. Variations in current level have a great impact on brightness uniformity of an AMOLED display. Thus, the quality of a pixel driving circuit is critical to the quality of an AMOLED display.

FIG. 1 shows a conventional 2T1C (2 transistors and 1 capacitor) pixel driving circuit 10 in an AMOLED display. Pixel driving circuit 10 comprises transistors Mx and My. When signal SCAN turns on transistor Mx, data signal shown as $V_{data}$ in the FIG. 1 is loaded into a gate of p-type transistor My and stored in capacitor Cst. Thus, there is a constant current driving display device EL to emit light. Typically, in an AMOLED display, a current source is implemented by a P-type TFT (My in FIG. 1) gated by data signal $V_{data}$ and having source and drain connected to $V_{dd}$ and the anode of display device EL, respectively, as shown in FIG. 1. The brightness of display device EL with respect to $V_{data}$ therefore has the following relation.

$$\text{Brightness} \propto \text{current} \propto (V_{dd}-V_{data}-V_{th})^2$$

Where $V_{th}$ is a threshold voltage of transistor My and $V_{dd}$ is a power supply voltage. However, since there is typically a variation in $V_{th}$ for a LTPS type TFT due to a low temperature polysilicon (LTPS) process, it is supposed that a non-uniformity problem in brightness exists in an AMOLED display if $V_{th}$ is not properly compensated. Moreover, a voltage drop in the power line also causes the brightness non-uniformity problem. To overcome such problems, implementation of a pixel driving circuit with threshold voltage $V_{th}$ and power supply voltage $V_{dd}$ compensation to improve display uniformity is required.

BRIEF SUMMARY OF THE INVENTION

A detailed description is given in the following embodiments with reference to the accompanying drawings.

An embodiment of a display image system with a pixel driving circuit is provided. The pixel driving circuit comprises a storage capacitor, a transistor, a transfer circuit, a driving element and a switch circuit. The storage capacitor comprises a first node and a second node. The transistor comprises a gate coupled to a discharge signal and is coupled between the first node and the second node, wherein the transistor is turned on by the discharge signal to discharge the storage capacitor during a first period. The transfer circuit is coupled to the first node of the storage capacitor. The transfer circuit transmits a data signal or a reference signal to the first node of the storage capacitor. The driving element comprises a first terminal coupled to a first fixed potential, a second terminal coupled to the second node of the storage capacitor, and a third terminal outputting a driving current. The switch circuit is coupled between the driving element and a display element, directs the driving element to operate as a diode during a second period and allows the driving current to be output to the display element during a third period.

Another embodiment of a display image system with a pixel driving circuit is provided. The pixel driving circuit comprises a storage capacitor, a transistor, a transfer circuit, a driving element and a switch circuit. The storage capacitor comprises a first node and a second node. The transistor comprises a gate receiving a discharge signal and is coupled between the first node and the second node, wherein the transistor is turned on by the discharge signal to discharge the storage capacitor during a first discharge period and a second discharge period. The transfer circuit is coupled to the first node of the storage capacitor. The transfer circuit transmits a data signal or a reference signal to the first node of the storage capacitor. The driving element comprises a first terminal coupled to a first fixed potential, a second terminal coupled to the second node of the storage capacitor and a third terminal outputting a driving current. The switch circuit is coupled to the driving element, a first display element and a second display element, directs the driving element to operate as a diode during a first data load period and a second data load period and allows the driving current respectively to be output to the first display element and the second display element during a first emission period and a second emission period.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
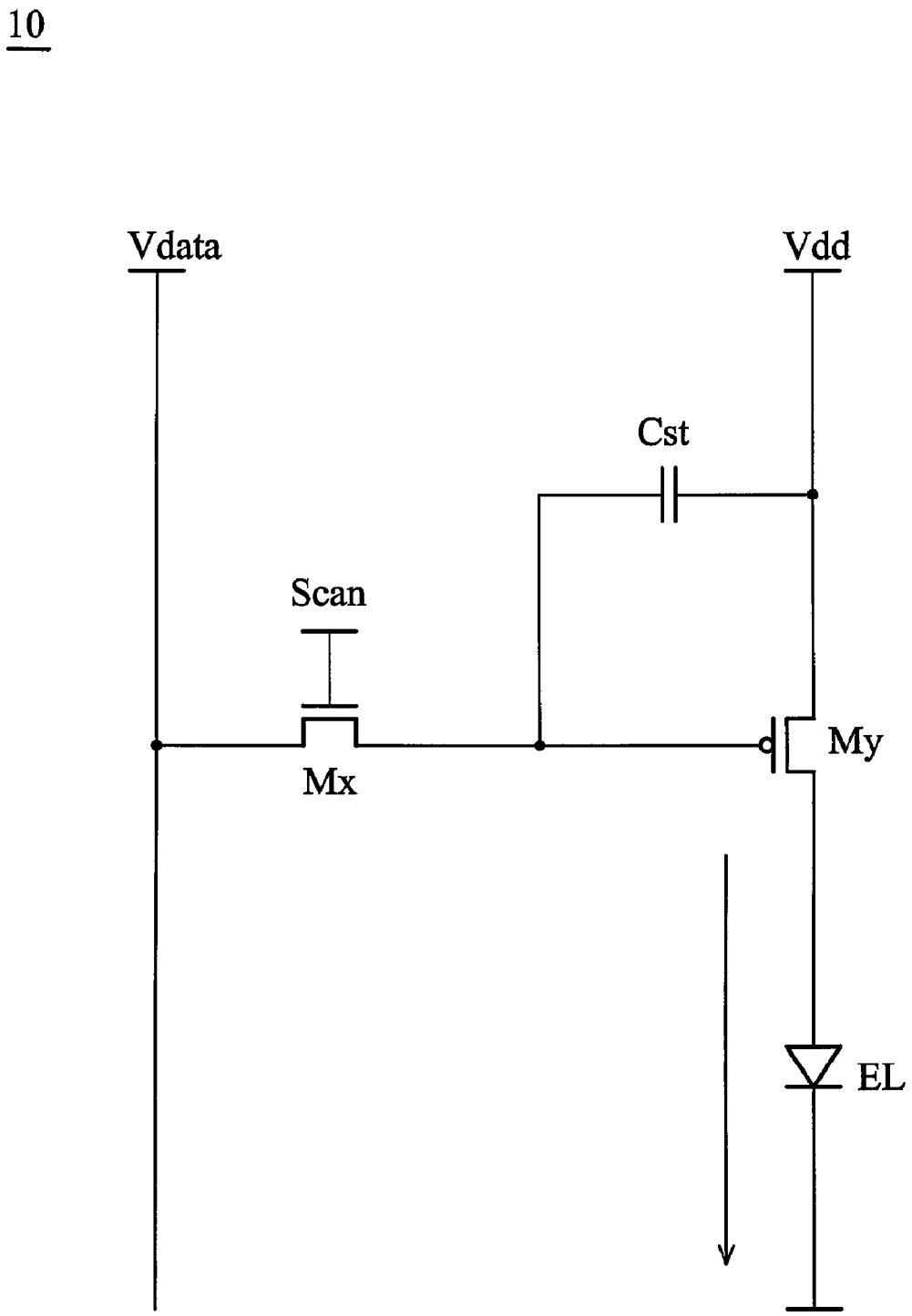
FIG. 1 (PRIOR ART)
FIG. 1 shows a conventional 2T1C (2 transistors and 1 capacitor) pixel driving circuit in an AMOLED display.
Figure 2:
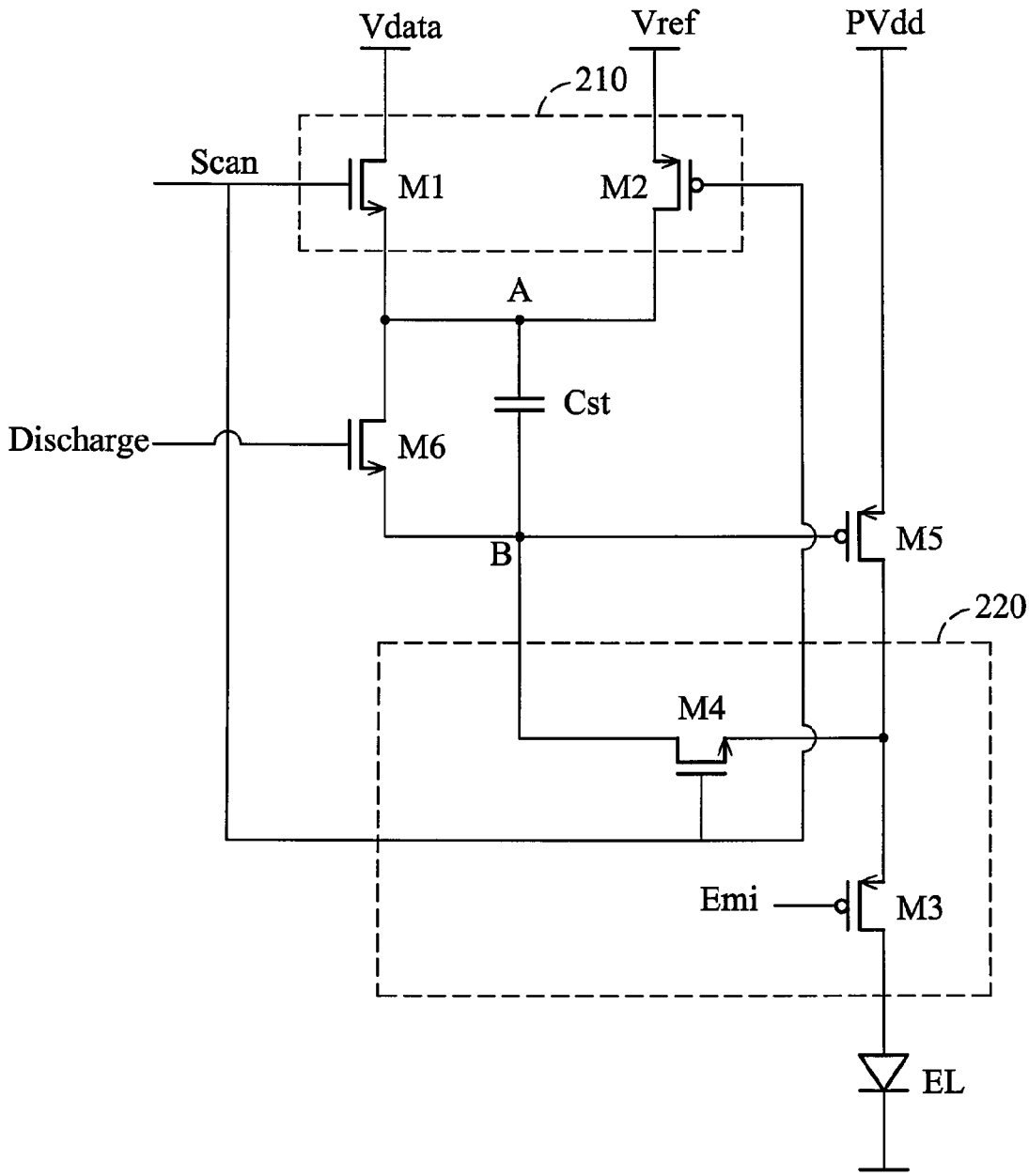
FIG. 2 shows a pixel driving circuit according to an embodiment of the invention.

FIG. 2 shows a pixel driving circuit 200 according to an embodiment of the invention. Pixel driving circuit 200 compensates a threshold voltage and a power loss, such that the voltage of power supply PVdd is not limited by scan signal Scan. Pixel driving circuit 200 comprises storage capacitor Cst, transfer circuit 210, driving transistor (driving element) M5, transistor M6 and switch circuit 220.

Transfer circuit 210 is coupled to first node A of storage capacitor Cst and transmits data signal Vdata or reference signal Vref to first node A of storage capacitor Cst. Reference signal Vref may be a fixed voltage signal. Driving transistor M5 may be a PTFT (positive-channel thin film transistor) transistor. A source terminal of transistor M5 is coupled to first voltage PVdd. A gate terminal of transistor M5 is coupled to second node B of storage capacitor Cst. More specifically, first voltage is power supply PVdd. Switch circuit 220 is coupled to a drain terminal of transistor M5. Switch circuit 220 directs transistor M5 to operate as a diode, such that transistor M5 becomes a diode-connected transistor once fourth transistor M4 is turned on. Display device EL is coupled to switch circuit 220. Preferably, display device EL is an electroluminescent device. Additionally, a cathode of display device EL is coupled to a second voltage. More specifically, the second voltage is voltage VSS or ground voltage.

Transfer circuit 210 comprises first transistor M1 and second transistor M2, as shown in FIG. 2, wherein first transistor M1 and second transistor M2 are an NTFT (negative-channel thin film transistor) transistor and a PTFT transistor, respectively. A drain terminal of first transistor M1 receives data signal Vdata. A gate terminal and a source terminal of first transistor M1 are connected to first scan line Scan and first node A of storage capacitor Cst, respectively. A source terminal of second transistor M2 receives reference signal Vref. A gate terminal and a drain terminal of second transistor M2 are connected to scan line Scan and first node A of storage capacitor Cst, respectively. Preferably, transistors M1 and M2 are polysilicon thin film transistors, providing higher current driving capability.

When scan line signal Scan is pulled high, transfer circuit 210 transmits data signal Vdata to first node A of storage capacitor Cst. When scan line signal Scan is pulled low, transfer circuit 210 transmits reference signal Vref to first node A of storage capacitor Cst.

Switch circuit 220 comprises third transistor M3 and fourth transistor M4. As shown in FIG. 2, third transistor M3 is a PMOS transistor and fourth transistor M4 is a NMOS transistor. A drain terminal of third transistor M3 is connected to an anode of display device EL, while a gate terminal and a source terminal of third transistor M3 are connected to lighting signal Emi and driving transistor M5, respectively. Fourth transistor M4 comprises a source terminal coupled to driving transistor M5 and third transistor M3. A drain terminal of fourth transistor M4 is coupled to second node B of storage capacitor Cst, a source terminal of transistor M6 and a gate terminal of driving transistor M5. A gate terminal of fourth transistor M4 is connected to scan line Scan. Preferably, transistors M3 and M4 are polysilicon thin film transistors, providing higher current driving capability.

When scan line signal Scan is pulled high, fourth transistor M4 of switch circuit 220 directs driving transistor M5 to operate as a diode, becoming a diode-connected transistor once fourth transistor M4 is turned on.

A drain terminal of transistor M6 is coupled to first node A of storage capacitor Cst. A gate terminal of transistor M6 is coupled to discharge signal Discharge. A source terminal of transistor M6 is coupled to second node B of storage capacitor Cst, the drain terminal of transistor M4 and the gate terminal of driving transistor M5.

Figure 3:
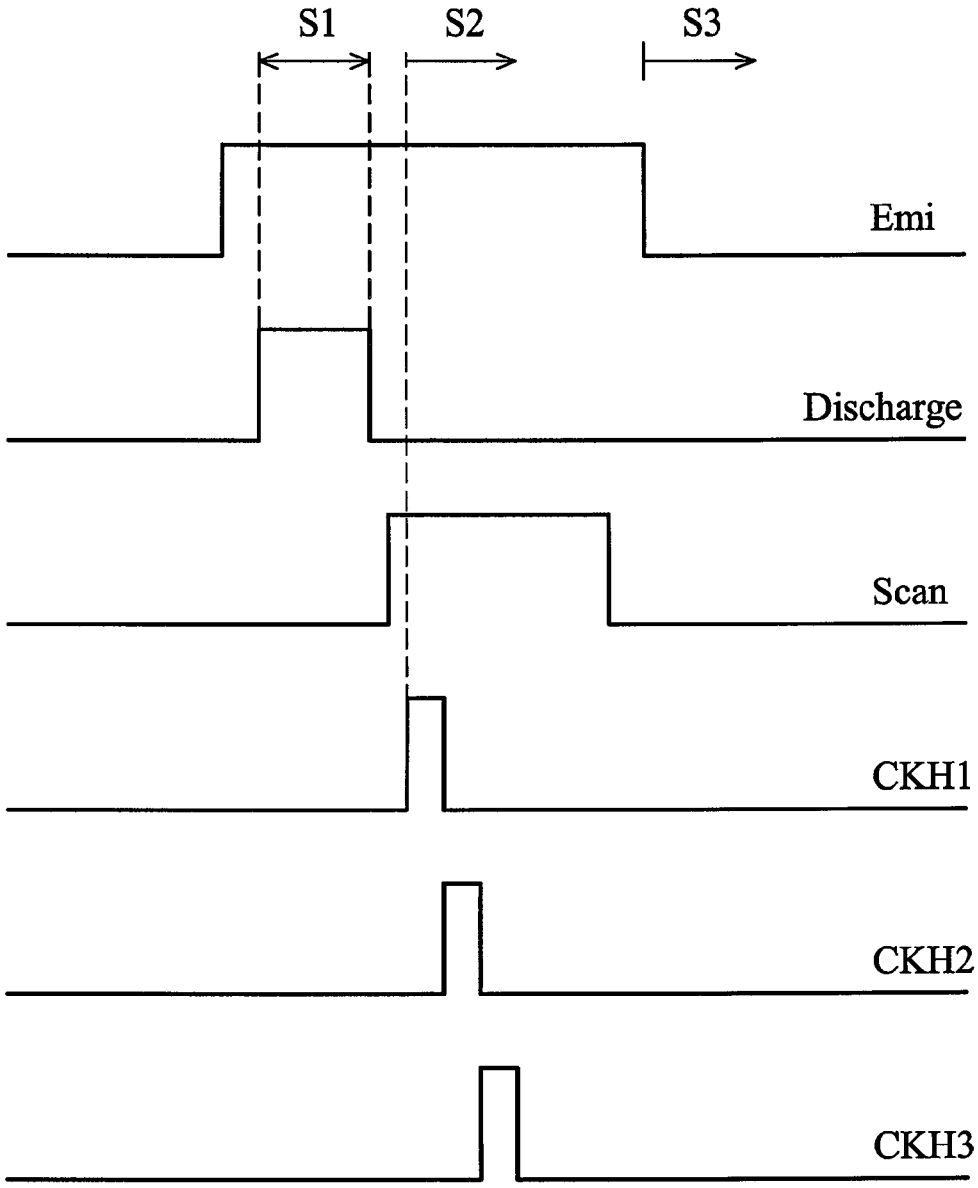
FIG. 3 is a timing diagram of a lighting signal, a discharge signal, a scan line signal, and horizontal clock signals of a pixel driving circuit shown in FIG. 2.

FIG. 3 is a timing diagram of lighting signal Emi, discharge signal Discharge, scan line signal Scan, and horizontal clock signals CKH1, CKH2 and CKH3 of a pixel driving circuit 200 shown in FIG. 2. From a previous emission mode of the pixel driving circuit, when discharge signal Discharge is pulled high and lighting signal Emi is kept high, pixel driving circuit 200 of FIG. 2 is in discharge mode S1. In discharge mode S1, transistor M6 is turned on, and a high-level reference signal Vref is input to first node A and second node B of storage capacitor Cst. The charge stored in storage capacitor Cst is thus discharged in the discharge mode. The discharge of storage capacitor Cst ensures normal operation in subsequent steps.

Following the discharge of storage capacitor Cst, scan line signal Scan is pulled high, then pixel driving circuit 200 enters data load mode S2. When scan signal Scan is pulled high, first transistor M1 and fourth transistor M4 are turned on while second transistor M2 and transistor M6 are turned off. Since first transistor M1 and fourth transistor M4 are turned on, the voltage of first node A of storage capacitor Cst equals the voltage of data signal Vdata, where $V_{th}$ is the threshold voltage of driving transistor M5. The voltage of second node B of storage capacitor Cst equal to Pvdd−Vth. Thus, the stored voltage across storage capacitor is Vdata−(PVdd−Vth).

When scan signal Scan is pulled low, data load mode S2 ends. When lighting signal Emi is pulled low, pixel-driving circuit 200 enters emission mode S3. Since scan line signal Scan is low, second transistor M2 is turned on and the voltage of first node A of storage capacitor Cst is reference voltage Vref. Since the stored voltage across storage capacitor cannot be changed immediately, the voltage of second node B of storage capacitor Cst becomes Vref−[Vdata+(PVdd−Vth)]. Current through the display device is proportional to $(Vsg-Vth)^2$ and also proportional to $(Vdata-Vref)^2$. Thus, the current through display device EL is independent of threshold voltage $V_{th}$ of driving transistor M5 as well as power supply PVdd. The operation repeats continuously to control pixel emissions.

Figure 4:
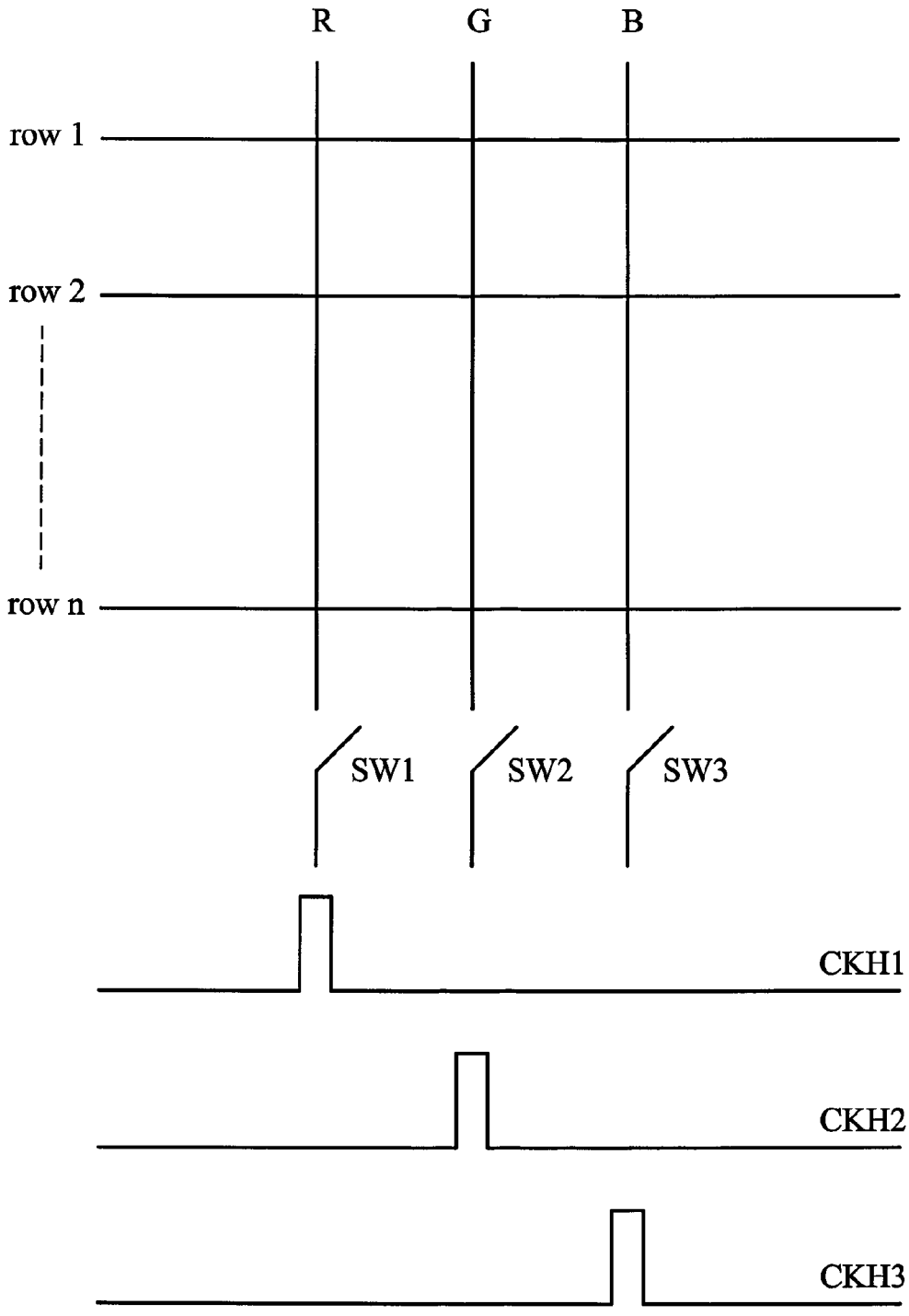
FIG. 4 shows an AMOLED display loading data into red R, green G and blue B signal lines respectively by using horizontal clock signals CKHL1, CKH2 and CKH3.

FIG. 4 shows an AMOLED display loading data into red R, green G and blue B signal lines respectively by using horizontal clock signals CKH1, CKH2 and CKH3. When scan line signal Scan at row1, row2 . . . or rown is high, in data load mode S2, horizontal clock signals CKH1, CKH2 and CKH3 respectively turn on switches SW1, SW2 and SW3 sequentially and data is loaded in red R, green G and blue B signal lines sequentially.

Figure 5:
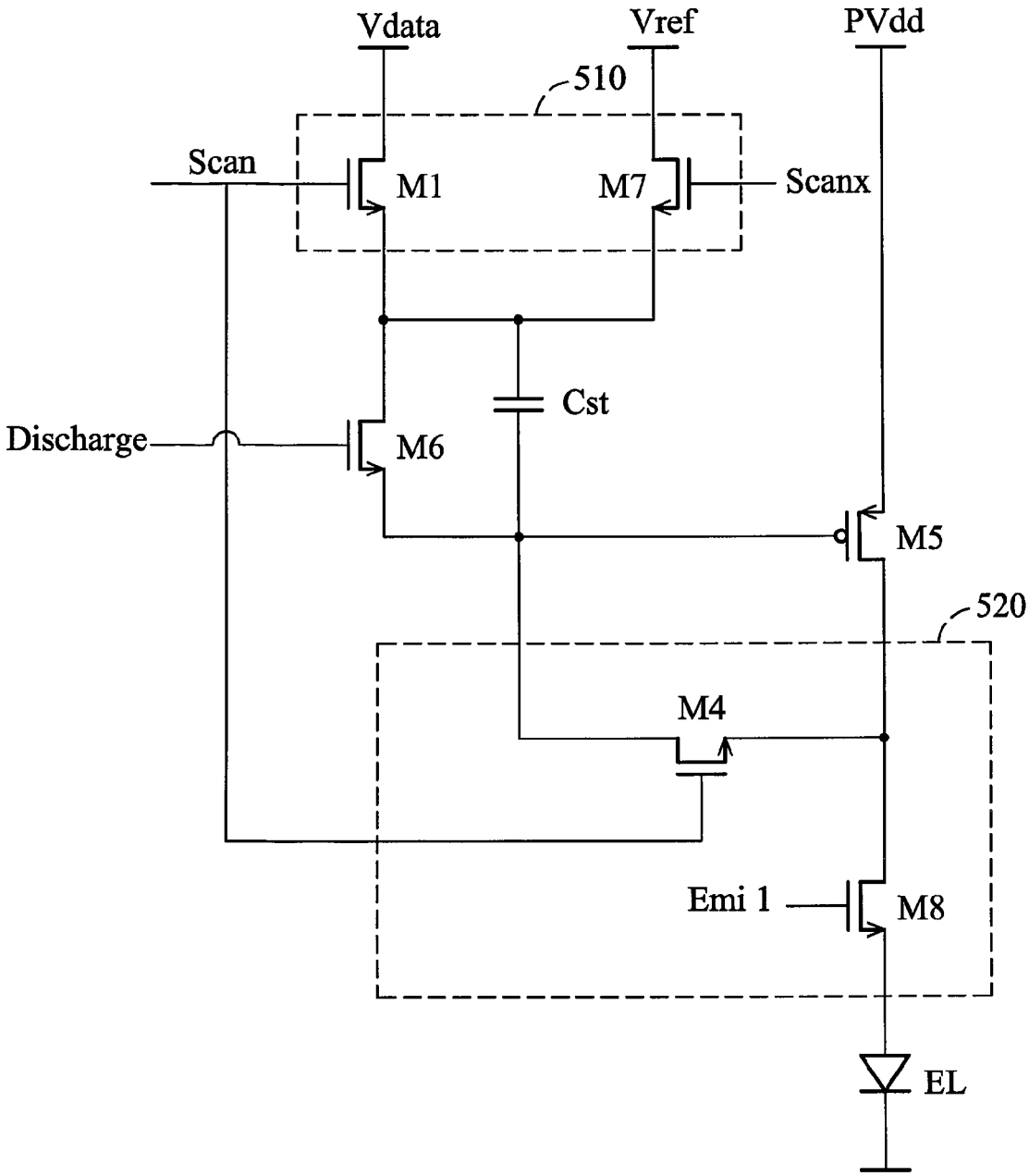
FIG. 5 shows a pixel driving circuit according to another embodiment of the invention.

FIG. 5 shows pixel driving circuit 500 according to another embodiment of the invention. Pixel driving circuit 500 compensates a threshold voltage and a power supply, such that voltage of power supply PVdd is not limited by scan signal Scan. Pixel driving circuit 500 is similar to pixel driving circuit 200, except that transistors M7 and M8 of FIG. 5 are NTFT transistors while second transistor M2 and third transistor M3 of FIG. 2 are PTFT transistors. A gate terminal of transistor M7 of FIG. 5 is coupled to inverse scan line signal ScanX. The phase of inverse scan line signal ScanX is opposite to that of scan line signal Scan.

Figure 6:
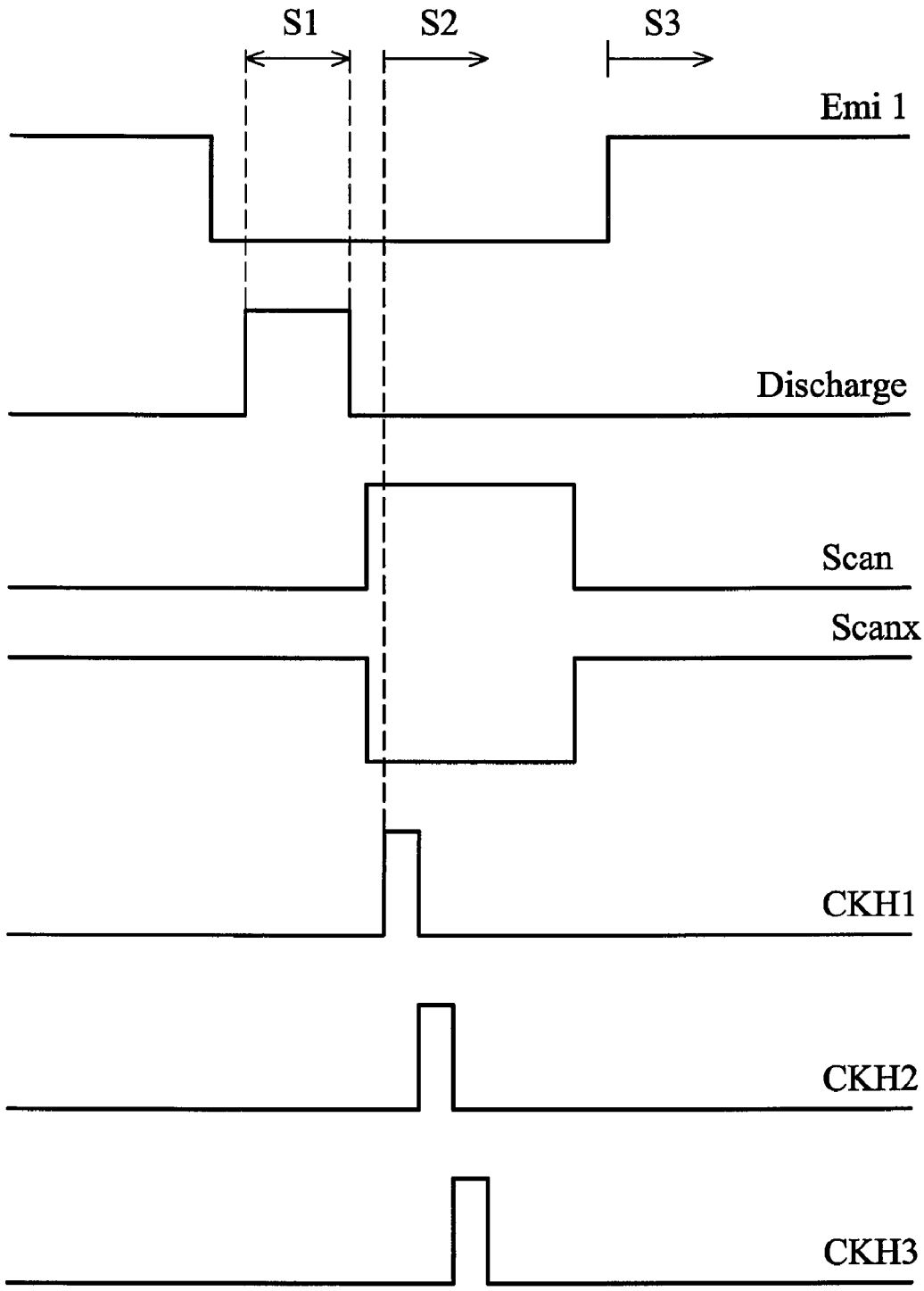
FIG. 6 is a timing diagram of signals of lighting signal, discharge signal, scan line signal, inverse scan line signal, and horizontal clock signals of a pixel driving circuit shown in FIG. 5.

FIG. 6 is a timing diagram of signals of lighting signal Emi, discharge signal Discharge, scan line signal Scan, inverse scan line signal ScanX, and horizontal clock signals CKH1, CKH2 and CKH3 of a pixel driving circuit 500 shown in FIG. 5. From a previous emission mode of the pixel driving circuit, when discharge signal Discharge is pulled low and lighting signal Emi is kept low, pixel driving circuit 500 of FIG. 5 is operated in discharge mode S1. In discharge mode S1, transistor M6 is turned on, and a high-level reference signal Vref is input to first node A and second node B of storage capacitor Cst. The charge stored in storage capacitor Cst is thus discharged in the discharge mode. The discharge of storage capacitor Cst ensures normal operation in subsequent steps.

Figure 7:
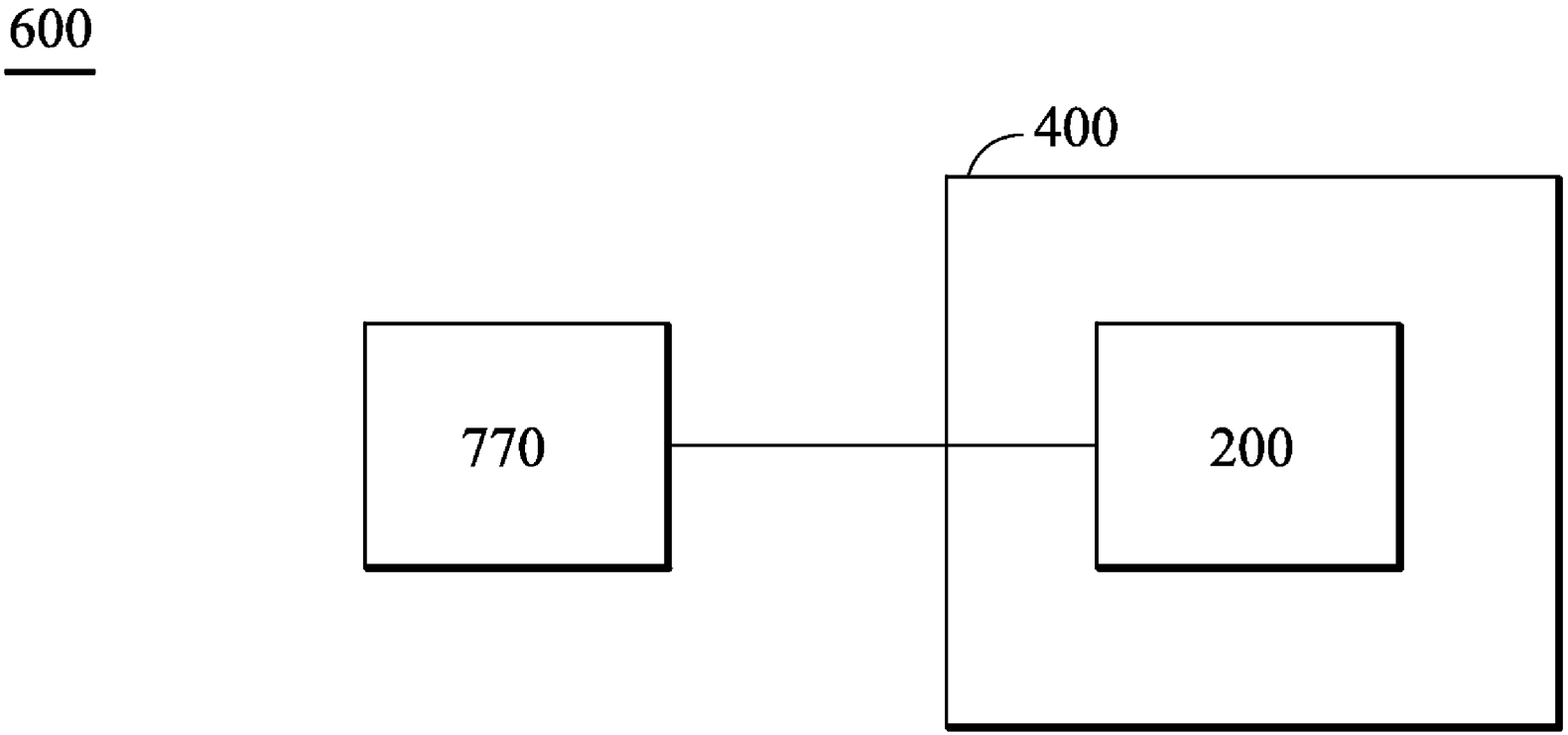
FIG. 7 schematically shows another embodiment of a system for displaying images according to the invention.

FIG. 7 schematically shows another embodiment of a system for displaying images which, in this case, is implemented as display panel 400 or electronic device 600. As shown in FIG. 7, display panel 400 comprises a pixel driving circuit 200 of FIG. 2. Display panel 400 can form a portion of a variety of electronic devices (in this case, electronic device 600). Generally, electronic device 600 can comprise display panel 400 and power supply 770. Further, power supply 770 is operatively coupled to display panel 400 and provides power to display panel 400. Electronic device 600 can be a mobile phone, digital camera, PDA (personal data assistant), notebook computer, desktop computer, television, or portable DVD player, for example.

The operation of FIG. 5 is similar to that of FIG. 2. Thus, the electrical current through display device EL of FIG. 5 is proportional to $(Vsg-Vth)^2$ and is also proportional to $(Vdata-Vref)^2$, and the current through display device EL of FIG. 5 is independent of threshold voltage $V_{th}$ of driving transistor M5 as well as power supply PVdd. The operation repeats continuously to control pixel emissions.

Pixel driving circuits 200 and 500 (FIGS. 2 and 5) of the embodiments of the present invention are independent of threshold voltage $V_{th}$ of driving transistor M5 as well as power supply PVdd. Power supply PVdd and scan line signal Scan are independent of each other. Thus, the voltage range of scan line signal Scan is not limited by the voltage range of power supplies PVdd, and vice versa.

Since a display panel comprises more and more pixels and need to provide more and more colors, design engineers often increase different color emitting light units to increase pixels and colors. A conventional emitting light unit (pixel driving circuit 10) comprises a display device EL and a corresponding driving circuit. Since the driving circuit cannot emit light, reducing the size of the driving circuit is required for higher aperture ratio. The challenge for design engineers is thus, to put less driving circuits and more display devices in a fixed sized display panel.

Figure 8:
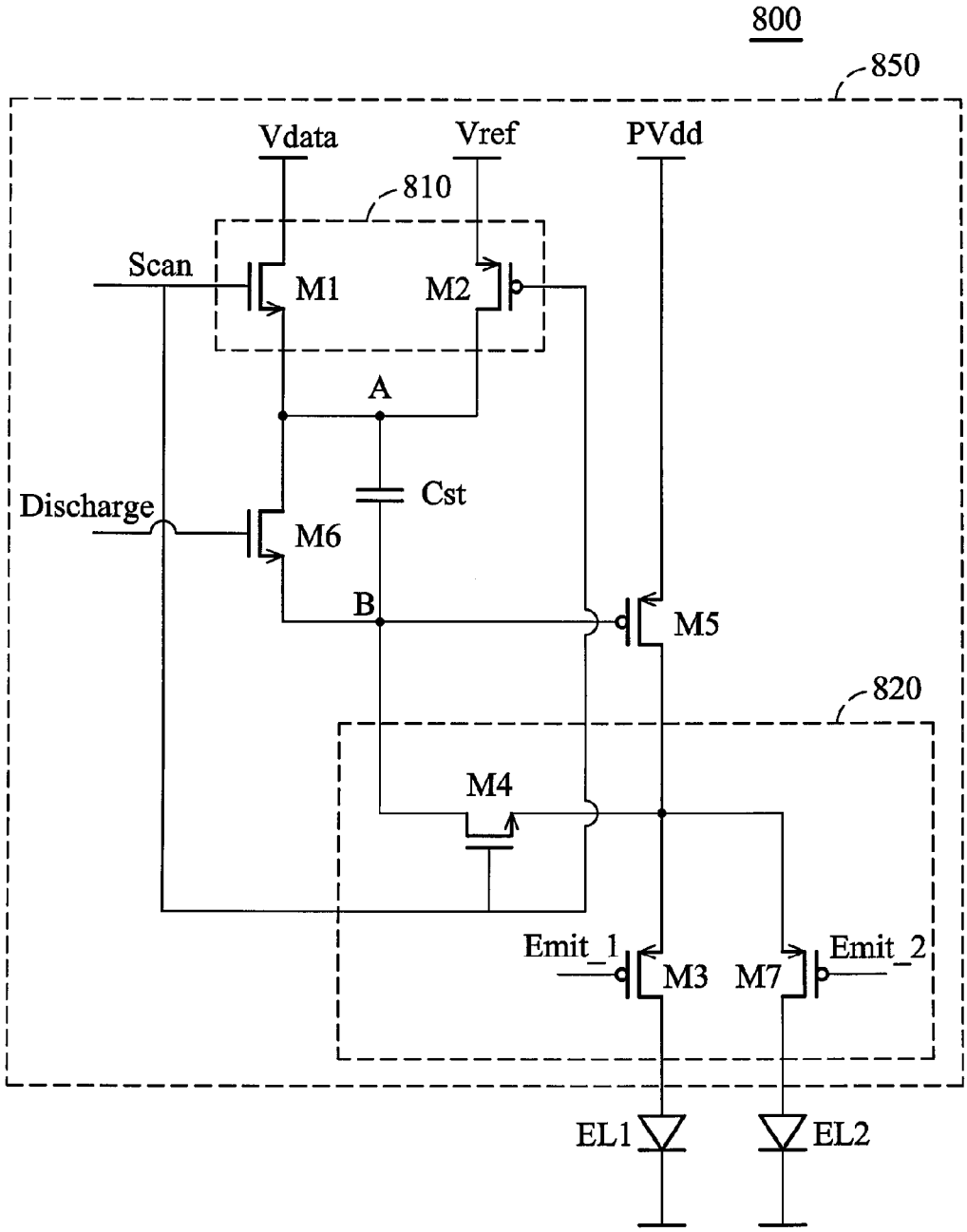
FIG. 8 shows a pixel driving circuit according to another embodiment of the invention.

FIG. 8 shows a pixel driving circuit 800 according to an embodiment of the invention. Pixel driving circuit 800 is a 5T1C+2C design circuit. In addition, pixel-driving circuit 800 compensates a threshold voltage and a power loss, such that the voltage of power supply PVdd is not limited by scan signal Scan. Pixel driving circuit 800 comprises storage capacitor Cst, transfer circuit 810, driving transistor (driving element) M5, transistor M6, switch circuit 820 and display devices EL1 and EL2. Display devices EL1 and EL2 can be emitting light units and share driving circuit 850 to provide more lighting area in pixel driving circuit 800. Display devices EL1 and EL2 respectively use driving circuit 850 in sub-frame periods SF1 and SF2.

Transfer circuit 810 is coupled to first node A of storage capacitor Cst and transmits data signal Vdata or reference signal Vref to first node A of storage capacitor Cst. Reference signal Vref is a fixed voltage signal. Driving transistor M5 is PTFT transistor. The source terminal of driving transistor M5 is coupled to power supply PVDD that is DC voltage. The gate terminal of driving transistor M5 is coupled to second node B of storage capacitor Cst. Switch circuit 820 is coupled to the drain terminal of driving transistor M5 and makes driving transistor M5 diode-connected. Display devices EL1 and EL2 are respectively coupled to transistors M3 and M7. In addition, the cathodes of display devices EL1 and EL2 are coupled to the second voltage. The second voltage can be ground or a fixed voltage VSS.

Transfer circuit 810 comprises first transistor M1 and second transistor M2, as shown in FIG. 8, wherein first transistor M1 and second transistor M2 are an NTFT transistor and a PTFT transistor, respectively. The drain and gate of first transistor M1 respectively receives data signal Vdata and scan signal Scan. The source terminal of first transistor M1 is connected to first node A of storage capacitor Cst. The source and gate terminals of second transistor M2 respectively receive reference signal Vref and scan signal Scan. The drain terminal of second transistor M2 is connected to first node A of storage capacitor Cst. Preferably, transistors M1 and M2 are polysilicon thin film transistors, providing higher current driving capability.

When scan line signal Scan is pulled high, transfer circuit 810 transmits data signal Vdata to first node A of storage capacitor Cst. When scan line signal Scan is pulled low, transfer circuit 810 transmits reference signal Vref to first node A of storage capacitor Cst.

Switch circuit 820 comprises transistors M3, M4 and M7. Transistors M3 and M7 are PTFT transistors and transistor M4 is an NMOS transistor. The drain terminals of transistors M3 and M7 are respectively connected to anodes of display devices EL1 and EL2, the gate terminals of transistors M3 and M7 respectively receive lighting signal Emit_1 and Emit_2 and the source terminals of transistors M3 and M7 are coupled to driving transistor M5. Transistor M4 comprises a source terminal coupled to driving transistor M5 and transistors M3 and M7 and a drain terminal coupled to second node B of storage capacitor Cst, the source terminal of transistor M6 and the gate terminal of driving transistor M5. The gate of transistor M4 receives scan line signal Scan. Preferably, transistors M3 and M7 are polysilicon thin film transistors, providing higher current driving capability. When scan line signal Scan is pulled high, transistor M4 of switch circuit 820 directs driving transistor M5 to operate as a diode, becoming a diode-connected transistor once transistor M4 is turned on.

The drain terminal of transistor M6 is coupled to first node A of storage capacitor Cst. The gate terminal of transistor M6 receives discharge signal Discharge. The source terminal of transistor M6 is coupled to second node B of storage capacitor Cst, the drain terminal of transistor M4 and the gate terminal of driving transistor M5.

Figure 9:
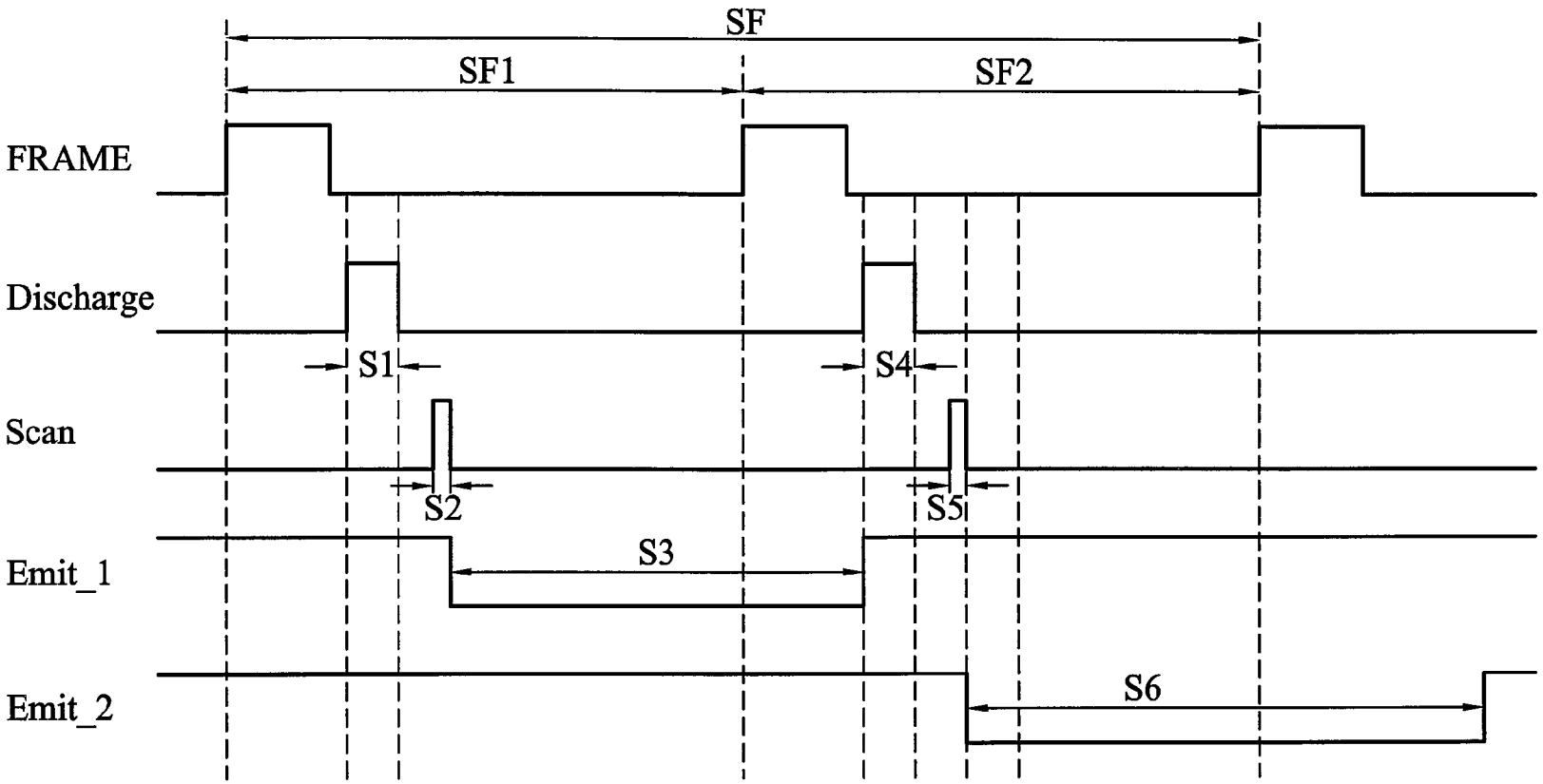
FIG. 9 is a timing diagram of a frame signal, a discharge signal, a scan line signal and lighting signals according to the embodiment of the invention shown in FIG. 8.

FIG. 9 is a timing diagram of frame signal FRAME, discharge signal Discharge, scan line signal Scan and lighting signals Emit_1 and Emit_2 according to the embodiment of the invention shown in FIG. 8. Pixel driving circuit 800 decides sub-frame period SF1 or sub-frame period SF2 according to frame signal FRAME. A frame period comprises sub-frame period SF1 and sub-frame period SF2. During sub-frame period SF1, when discharge signal Discharge is pulled high and lighting signal Emit_1 is maintained at high voltage level, pixel driving circuit 800 is operated at discharge mode S1. During discharging period S1, transistor M6 is turned on and scan signal Scan is at low voltage level. Thus, reference signal Vref is stored at first node A and second node B of storage capacitor Cst to discharge storage capacitor Cst. The discharge of storage capacitor Cst ensures normal operation in subsequent steps.

Following the discharge of storage capacitor Cst, scan line signal Scan is pulled high, then pixel driving circuit 800 enters data load mode S2. When scan line signal Scan is pulled high, transistor M1 and transistor M4 are turned on while transistor M2 and transistor M6 are turned off. Since transistor M1 and transistor M4 are turned on, the voltage of first node A of storage capacitor Cst equals the voltage of data signal Vdata, where $V_{th}$ is the threshold voltage of driving transistor M5. The voltage of second node B of storage capacitor Cst equal to Pvdd−Vth. Thus, the stored voltage across storage capacitor is Vdata−(PVdd−Vth).

When scan line signal Scan is pulled low, data load mode S2 ends. When lighting signal Emi_1 is pulled low, pixel-driving circuit 800 enters emission mode S3. Since scan line signal Scan is at low voltage level, second transistor M2 is turned on and the voltage of first node A of storage capacitor Cst is reference voltage Vref. Since the voltage across storage capacitor cannot be changed immediately, the voltage of second node B of storage capacitor Cst becomes Vref−[Vdata+(PVdd−Vth)]. Currents through the display devices EL1 and EL2 are proportional to $(Vsg-Vth)^2$ and also proportional to $(Vdata-Vref)^2$. Thus, during sub-frame period SF1, the current through display device EL1 is independent of threshold voltage $V_{th}$ of driving transistor M5 as well as power supply PVdd.

During sub-frame period SF2, lighting signal Emit_1 is maintained at high voltage level. During sub-frame period SF2, discharge signal Discharge, scan line signal Scan and lighting signal Emit_2 repeat the emitting light sequence of sub-frame period SF1. When discharge signal Discharge is pulled high and lighting signal Emit_2 is maintained at high voltage level, pixel-driving circuit 800 is operated at discharge mode S4 and storage capacitor Cst discharges charges. When scan line signal Scan is pulled high, pixel-driving circuit 800 enters data load mode S5. When scan line signal Scan is pulled low, data load mode S2 ends. When lighting signal Emi_2 is pulled low, pixel-driving circuit 800 enters emission mode S6. Other operations at sub-frame period SF2 are the same as those at sub-frame period SF1. Thus, during sub-frame period SF2, the current through display device EL2 is independent of threshold voltage $V_{th}$ of driving transistor M5 as well as power supply PVdd. As shown in FIG. 9, discharge mode S1, data load mode S2, emission mode S3, discharge mode S4, data load mode S5 and emission mode S5 occur in order.

Pixel driving circuit 800 is independent of threshold voltage $V_{th}$ of driving transistor M5 as well as power supply PVdd. And power supply PVDD is independent of the voltage level of scan line signal Scan. Thus, the voltage range of scan line signals Scan is not limited to the voltage range of power supply PVdd. Display devices EL1 and EL2 share driving circuit 850 to increase the lighting areas of display devices EL1 and EL2 of pixel driving circuit 800.

Figure 10:
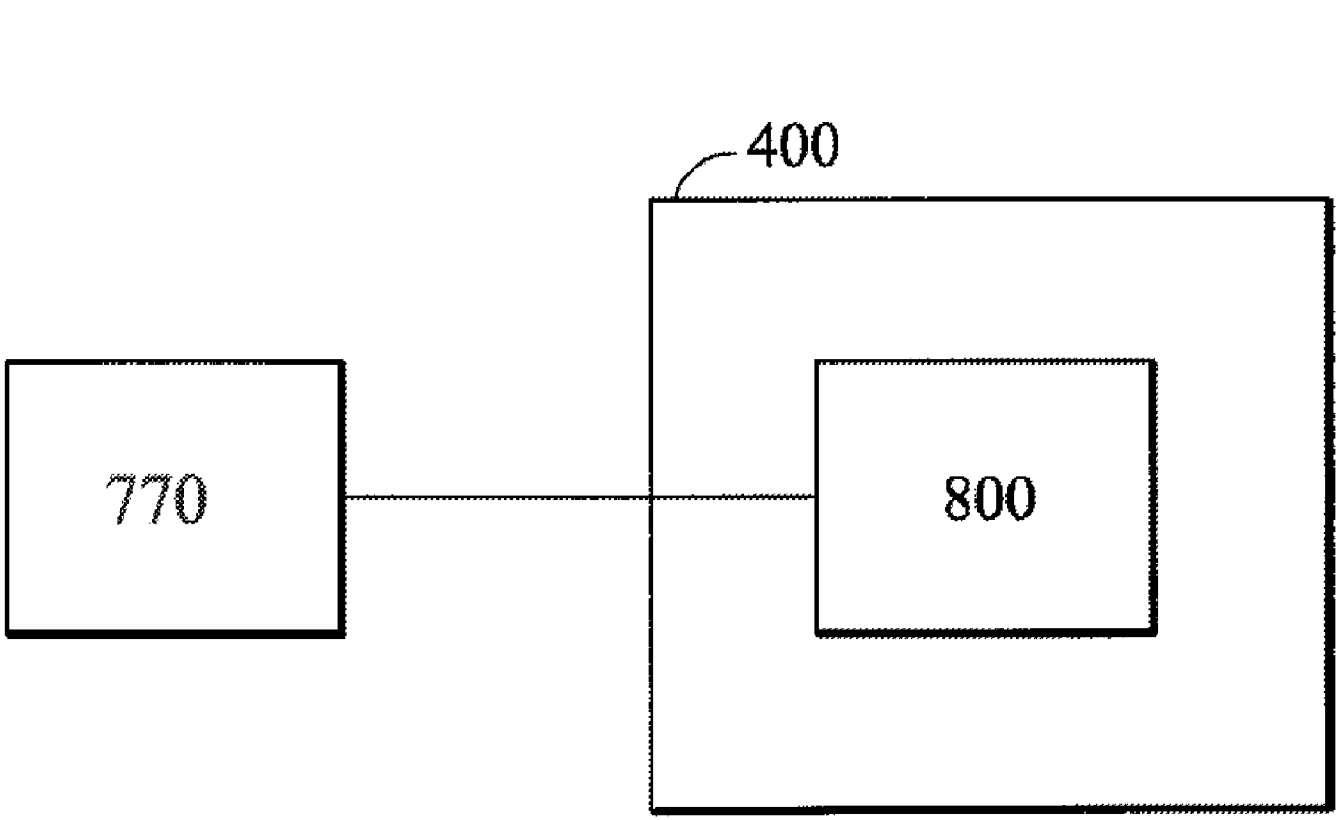
FIG. 10 schematically shows another embodiment of a system for displaying images according to the invention.

FIG. 10 schematically shows another embodiment of a system for displaying images according to the invention that, in this case, is implemented as display panel 400 or electronic device 600. As shown in FIG. 10, display panel 400 comprises a pixel driving circuit 800 of FIG. 8. Display panel 400 can form a portion of a variety of electronic devices (in this case, electronic device 600). Generally, electronic device 600 can comprise display panel 400 and power supply 770. Further, power supply 770 is operatively coupled to display panel 400 and provides power to display panel 400. Electronic device 600 can be a mobile phone, digital camera, PDA (personal data assistant), notebook computer, desktop computer, television, or portable DVD player, for example.

While the invention has been described by way of example and in terms of preferred embodiment, it is to be understood that the invention is not limited to thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for displaying images, comprising:

a pixel driving circuit, comprising:

a storage capacitor comprising a first node and a second node;

a transistor comprising a gate coupled to a discharge signal, coupled between the first node and the second node, wherein the transistor is turned on by the discharge signal to discharge the storage capacitor during a first period;

a transfer circuit coupled to the first node of the storage capacitor, the transfer circuit transmitting a data signal or a reference signal to the first node of the storage capacitor;

a driving element comprising a first terminal coupled to a first fixed potential, a second terminal coupled to the second node of the storage capacitor, and a third terminal outputting a driving current; and a switch circuit coupled between the driving element and a display element, directing the driving element to operate as a diode during a second period and allowing the driving current to be output to the display element during a third period.

2. The system as claimed in claim 1, wherein the transfer circuit comprises:

a first transistor comprising a fourth terminal coupled to a first scan line, a fifth terminal receiving the data signal, and a sixth terminal coupled to the first node of the storage capacitor; and a second transistor comprising a seventh terminal coupled to the first scan line, an eighth terminal receiving the reference signal, and a ninth terminal coupled to the first node of the storage capacitor.

3. The system as claimed in claim 1, wherein the transfer circuit comprises:

a first transistor comprising a fourth terminal coupled to a first scan line, a fifth terminal receiving the data signal, and a sixth terminal coupled to the first node of the storage capacitor; and a second transistor comprising a seventh terminal coupled to a second scan line, an eighth terminal receiving the reference signal, and a ninth terminal coupled to the first node of the storage capacitor.

4. The system as claimed in claim 1, wherein the switch circuit comprises:

a third transistor comprising a fourth terminal coupled to a lighting signal, a fifth terminal coupled to the display element, and a sixth terminal coupled to the driving element; and a fourth transistor comprising a seventh terminal coupled to the second node of the storage capacitor, an eighth terminal coupled to a first scan line, and a ninth terminal coupled to the driving element.

5. The system as claimed in claim 1, further comprising a display panel, wherein the pixel driving circuit forms a portion of the display panel.

6. A method for driving a display element with a driving element and a storage capacitor, comprising:

discharging the storage capacitor through a transistor by applying a discharge signal thereto;

loading a data signal into a first terminal of the storage capacitor;

loading a gate voltage of the driving element into a second terminal of the storage capacitor;

loading a reference signal into the first terminal of the storage capacitor; and coupling the loaded data signal, the gate voltage and the reference signal into the driving element to provide a threshold-independent driving current to the display element.

7. The method as claimed in claim 6, wherein loading begins at a discharge signal applied to a switch element for applying the reference signal to both terminals of the storage capacitor.

8. The method as claimed in claim 7, wherein discharge normalizes voltage at the first terminal and second terminal of the storage capacitor by turning on the transistor.

9. The method as claimed in claim 6, wherein the loaded data signal, the gate voltage and the reference signal are coupled to the driving element after the reference signal is applied on the storage capacitor.

10. A system for displaying images, comprising:

a pixel driving circuit, comprising:

a storage capacitor comprising a first node and a second node;

a transistor comprising a gate receiving a discharge signal and coupled between the first node and the second node, wherein the transistor is turned on by the discharge signal to discharge the storage capacitor during a first discharge period and a second discharge period;

a transfer circuit coupled to the first node of the storage capacitor, the transfer circuit transmitting a data signal or a reference signal to the first node of the storage capacitor;

a driving element comprising a first terminal coupled to a first fixed potential, a second terminal coupled to the second node of the storage capacitor, and a third terminal outputting a driving current; and a switch circuit coupled to the driving element, a first display element and a second display element, directing the driving element to operate as a diode during a first data load period and a second data load period and allowing the driving current respectively to be output to the first display element and the second display element during a first emission period and a second emission period.

11. The system as claimed in claim 10, wherein the first display element and the second display element share the driving element, the transfer circuit, the storage capacitor and the transistor.

12. The system as claimed in claim 11, wherein the first display element emits light during the first emission period and the second display element emits light during the second emission period.

13. The system as claimed in claim 10, wherein the driving current is proportional to (Vdata−Vref)2 during the first and second emission periods.

14. The system as claimed in claim 10, wherein the transfer circuit comprises:

a first transistor receiving the first scan line signal and the data signal and coupled to the first node;

a second transistor receiving the first scan line signal and the reference signal and coupled to the first node.

15. The system as claimed in claim 14, wherein the first transistor comprises a gate terminal to receive the first scan line signal, a drain terminal to receive the data signal and a source terminal to couple to the first node and the second transistor comprises a gate terminal to receive the first scan line signal, a drain terminal to receive the reference signal and a source terminal to couple to the first node.

16. The system as claimed in claim 10, wherein the first discharge period, the first data load period and the first emission period occur in order.

17. The system as claimed in claim 10, wherein the second discharge period, the second data load period and the second emission period occur in order.

18. The system as claimed in claim 10, wherein the switch circuit comprises:

a third transistor receiving a first emission signal and coupled between the first display element and the driving element;

a fourth transistor receiving a first scan line signal and coupled between the second node and the driving element; and a fourth transistor receiving a second emission signal and coupled between the second display element and the driving element.

19. The system as claimed in claim 10, wherein the fourth transistor comprises a gate terminal to receive the first scan line signal, a drain terminal coupled to the second node and a source terminal coupled to the driving element.

20. The system as claimed in claim 10, further comprising an electronic device, wherein the electronic device comprises:

the display panel; and a power supply coupled to and providing power to the display panel.

* * * * *